US012599825B2

(12) United States Patent
Phillips

(10) Patent No.: US 12,599,825 B2
(45) Date of Patent: Apr. 14, 2026

(54) SWIMMING MACHINE

(71) Applicants: Lighthouse Pools, Devon (GB); Daniel Phillips, Devon (GB)

(72) Inventor: Daniel Phillips, Devon (GB)

(73) Assignees: Lighthouse Pools, Devon (GB); Daniel Phillips, Devon (GB)

( * ) Notice: Subject to any disclaimer, the term of this patent is extended or adjusted under 35 U.S.C. 154(b) by 0 days.

(21) Appl. No.: 18/052,241

(22) Filed: Nov. 3, 2022

(65) Prior Publication Data

US 2023/0166170 A1 Jun. 1, 2023

(51) Int. Cl.
*A63B 69/12* (2006.01)

(52) U.S. Cl.
CPC ..... *A63B 69/125* (2013.01)

(58) Field of Classification Search
CPC ..... A63B 69/125
USPC ..... 4/496, 904
See application file for complete search history.

(56) References Cited

U.S. PATENT DOCUMENTS 5,298,003 A * 3/1994 Weihe ..... A63B 69/125 4/492
7,526,820 B2 * 5/2009 Murdock ..... E04H 4/144 4/492

FOREIGN PATENT DOCUMENTS

BR 202017021661 U2 * 2/2018
CN 103132558 A * 6/2013
CN 205260336 U * 5/2016
CN 211963012 U * 11/2020

* cited by examiner

*Primary Examiner* — Tuan N Nguyen
(74) *Attorney, Agent, or Firm* — Jose Cherson Weissbrot

(57) ABSTRACT

A swimming machine comprising a housing adapted to be mounted to an interior wall of a swimming pool. The housing comprising a hydraulic motor connected to an impellor mounted within the housing for producing a current of water in the pool when in use. The swimming machine further comprising a hydraulic pump stored outside the housing operably connected to the hydraulic motor mounted within the housing, an electric motor connected to and powering the hydraulic pump, an inverter drive system connected to, powering and controlling the electric motor. Wherein in use the speed of the current produced is controlled by the inverter drive system.

11 Claims, 5 Drawing Sheets

SWIMMING MACHINE

The present invention relates to a swimming machine to allow a person to swim in a swimming pool against a current. Specifically, the present invention relates to a swimming machine which can be used in a swimming pool, of a size typically not large enough to properly swim continuously in, to allow a person to swim continuously against a current. More specifically, the present invention relates to a swimming machine which may be retrofitted to a swimming pool which allows a person to swim continuously against a current.

BACKGROUND OF THE INVENTION

Most swimming pools are not suitable for swimming in because of the relatively small size of the pools. The length of the pools means that any individual swimming therein, setting off from one side, can only make a small number of full strokes before reaching the opposing side and having to turn around. This is very disruptive to the individual trying to exercise. And can even increase the risk of injury, with the chance of the individual colliding with the internal edge of the pool.

Swimming machines address this problem by producing a current within the swimming pool for the individual to swim against while remaining stationary with relation to the pool, allowing for uninterrupted distance swimming within a small swimming pool.

One problem that existed with existing swimming machines was powering the motor within the swimming pool without the risk of electrical fault causing a serious accident.

One solution to this problem was the use of a hydraulic motor within the swimming pool, the motor being powered by a hydraulic pump external from the pool, the pump being powered by an electric motor. The operating strength of the hydraulic motor being controlled by an individual via a proportional flow valve in the hydraulic oil system. This however means that the electric motor driving the pump is always operating at full speed and therefore has a reduced lifespan.

The other problem of prior art swimming machines that use hydraulic motors is that the hydraulic motor can also be worn down by constant exposure to the pool water and chemicals therein.

It is an object of the current invention to provide a swimming machine which addresses the problems raised above.

STATEMENT OF INVENTION

According to a first aspect of the invention there is provided a swimming machine comprising a housing adapted to be mounted to an interior wall of a swimming pool. The housing comprising a hydraulic motor connected to an impeller mounted within the housing for producing a current of water in the pool when in use. The swimming machine further comprising a hydraulic pump stored outside the housing operably connected to the hydraulic motor mounted within the housing, an electric motor connected to and powering the hydraulic pump, an inverter drive system connected to, powering and controlling the electric motor. Wherein in use the speed of the current produced is controlled by the inverter drive system.

An embodiment of the first aspect, wherein the hydraulic motor is encased in resin to make it waterproof. The resin can be an epoxy resin and can have a chemical resistant gel topcoat.

An embodiment of the first aspect, wherein the electric motor is a 4 kW 3 phase motor.

An embodiment of the first aspect, wherein the inverter drive system is a single phase to three phase inverter drive system.

An embodiment of the first aspect, wherein the hydraulic motor is a 50 CC hydraulic motor.

An embodiment of the first aspect, wherein the impeller has approximately a 42 cm2 area.

An embodiment of the first aspect, wherein the inverter drive system is connected to a controller which is controlled by a user via keypad. The keypad may be distal to the controller and both comprise a transmitter/receiver for wireless communication.

An embodiment of the first aspect, wherein the housing is substantially made from a fiberglass composite.

An embodiment of the first aspect, wherein mounted within the housing there is an array of turning vanes for directing the water flow produced by the impeller to a substantially horizontal direction. The housing may further comprise two water diffusers mounted in the housing, the first mounted between the impeller and the array of turning vanes, the second mounted in a wall of the housing on a side of the array of the tuning vanes distal the first diffuser.

DETAILED DESCRIPTION

Figure 1:
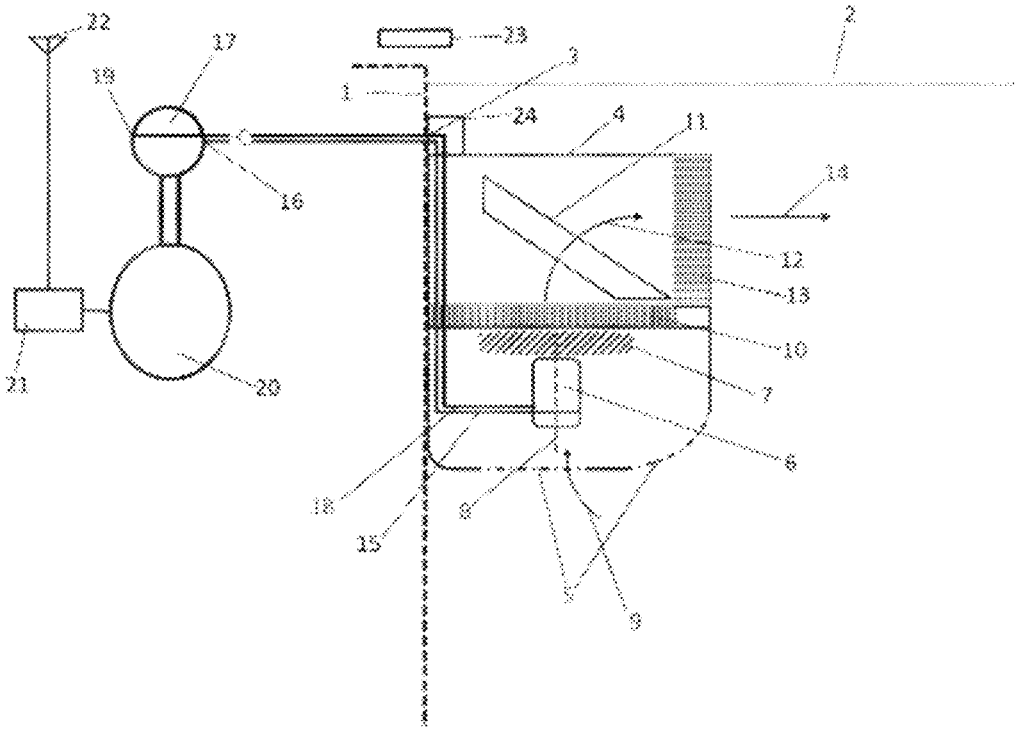
FIG. 1 depicts a schematic view of the machine and a diagram of the hydraulic circuit.

The swim jet of the present invention as shown in FIG. 1 comprises two main parts. A head unit located within the pool and power pack situated outside the pool. The head unit is installed on a wall 1 of a swimming pool. It can either be installed at the construction of the pool or retrofitted to an existing pool. The swim jest is located just below the surface 2 of the pool water and is fixed to an interior wall 1 of the swimming pool and is connected by a mounting bracket 3 to the pool wall 1.

The head unit itself comprises a housing 4 which encases the whole head unit, preferably made from a fiberglass composite. The lower half of the head unit comprises at least one preferably more inlets 5 which allow pool water from a deeper portion of the pool to enter the housing. Held in the lower half of the head unit is a hydraulic motor 6 attached to an impeller 7, the hydraulic motor 6 urging the impeller 7 to rotate about a rotation axis 8. The rotation axis 8 being substantially vertical/parallel with the pool wall 1.

The spinning impeller 7 sucks water in through the inlets 5 via path roughly indicated by arrow 9, and then urges the water up into the upper half of the head unit.

Just above the impeller 7 is a first water diffuser 10, preferably made from plastic, to straighten the water current urged by impeller 7 as it enters the upper half of the head unit such that the flow of the water current is substantially laminar in a vertical direction. The vertical laminar flow of water than passes through an array of turning vanes 11. The array of turning vanes 11, turn the substantially vertical water flow such that the direction of the water flow is now substantially horizontal in a direction into the pool. The water flow as it passes through the array of turning vanes 11 is roughly shown by arrow 12.

The now substantially horizontal water flow passes through a second diffuser 13 to straighten the flow of the water as it leaves the upper half of the head unit. This then creates the continuous horizontal laminar flow current of water 14 which a user can swim against.

The hydraulic motor 6 is preferably a 50 CC hydraulic motor which runs the impeller 7 which is preferably a 42 $cm^2$ impeller. The hydraulic motor is also preferably encapsulated in a chemical resistant resin to protect it from the pool water and increase its lifespan. The hydraulic motor 6 in the head unit is encapsulated by spraying 3 layers of a fine coating of epoxy resin, and using a fast acting curing agent. This is then completed with a top coat using a chemical resistant coloured gel coat for extra protection. The benefit of this encapsulation is it waterproofs the hydraulic motor 6 but still allows it to dissipate heat to the pool water and keep cool, therefore increasing the lifespan of the hydraulic motor 6.

Hydraulic fluid feed line 15 for the hydraulic motor 6 is connected to the high-pressure outlet 16 of hydraulic power pack 17. Hydraulic outlet line 18 of the hydraulic motor 6 is connected to the inlet 19 for the hydraulic power pack 17.

Hydraulic lines 15 and 18 go from the hydraulic motor 6 up through housing 4 until they pass through the top of housing 4, at this point they turn and go into the pool wall 1, either through our proximal brackets 3. Brackets 3 and hydraulic lines 15 and 18 are covered by a bespoke cap 24 which hides the pipes 15, 18 and mounting bracket 3 from view.

The hydraulic power pack 17 preferably comprises an electric motor (preferably a 4 KW three phase electric motor), a hydraulic pump powered by the motor, a reservoir for the hydraulic fluid, a filler filter, a level gauge, and a pressure gauge with a safety by-pass. The 4 KW three phase electric motor is powered by a single phase to three phase inverter drive system 20.

The inverter drive system 20 regulates the speed of the electric motor within the hydraulic power pack 17, which therefore controls the amount of power given to the hydraulic motor 6, which ultimately then controls the speed of the horizontal flow of water 14 which is swam against by a user.

Calibration and control of the inverter drive system can be done by a controller 21 connected to the inverter drive system 20. The controller 21 can be controlled by a user via a built-in keypad, alternatively or additionally the controller 21 can also be connected to a transmitter/receiver 22 (preferably a RF radio transmitter/receiver). Transmitter/receiver 22 communicates with user remote control 23.

Using inverter drive system 20 to control the motor speed of hydraulic power pack 17 to in turn control and regulate the speed of water flow 14 via hydraulic motor 6 is intrinsically better than traditional swim machines which instead control the speed of water flow via use of a proportional relief valve in the hydraulic system. This is because firstly the system of the current invention is more energy efficient as the motor driving the hydraulic pump only runs to the required speed rather than running near full speed constantly. Also the inverter drive system, even when running at full speed is more efficient than traditional drive systems.

Secondly, the user experience is better as there is less noise from the motor driving the hydraulic pump as it is not constantly running at full speed. And the user has greater control of the flow speed via the inverter drive system over control of a proportional flow valve of the traditional systems.

Thirdly the system of the current invention has a longer life span than traditional swim machine systems, the motor driving the hydraulic pump not running at full speed whenever in use increases the lifespan of the motor, and the hydraulic motor being encapsulated in resin, unlike traditional swim systems means that the hydraulic motor in the head unit also has a longer lifespan and does not need to be replaced as often.

Figure 2:
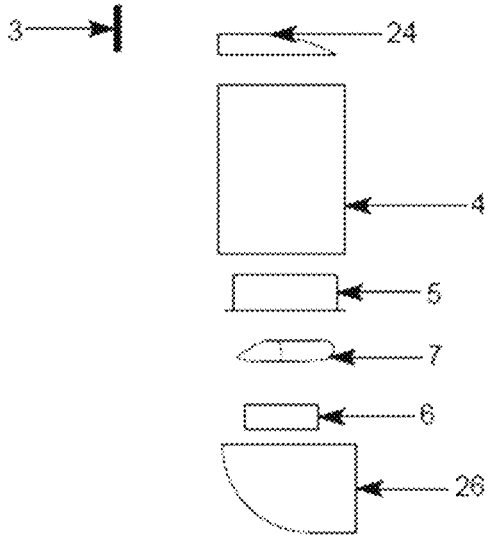
FIG. 2 depicts an exploded view of an embodiment of the invention.
Figure 3:
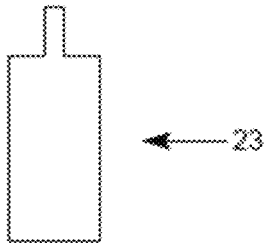
FIG. 3 depicts an embodiment of the remote module of the invention.
Figure 4:
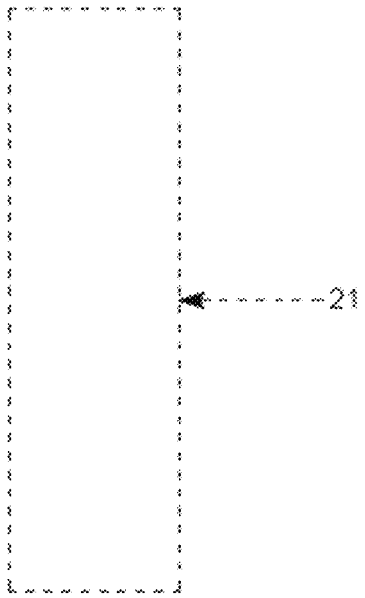
FIGS. 4 and 5 depict schematic embodiments of the invention.
Figure 5:
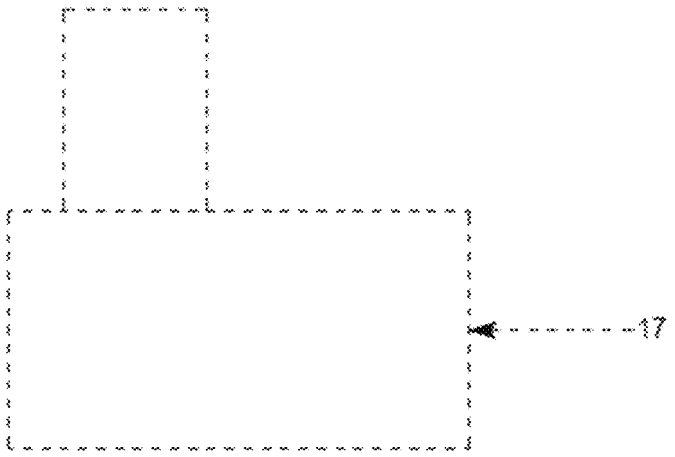

With regards to FIGS. 2 to 5 which depict a schematic and layout of the invention. FIG. 2 shows an exploded view of an embodiment of the invention, there is the mounting bracket 3 which attaches the invention to the inside wall of a swimming pool. This is covered from view by top cover 24. Main body 4 is the housing which encases the majority of the parts of the invention propeller housing 25 holds and protects propellor 7. Propeller 7 is in turn connected to hydraulic motor 6 which is encased in resin. On the bottom of main body 4 is filter section 26 which allows pool water to be drawn into the invention. FIG. 2 shows a preferred shape of a remote-control unit 23. FIGS. 4 and 5 show the inverter controller 21 and the hydraulic power pack 17 respectively.

The invention has been described with reference to a preferred embodiment. The description is intended to enable a skilled person to make the invention, not to limit the scope of the invention. The scope of the invention is determined by the claims.

The invention claimed is:

1. A swimming machine for swimming pool, comprising:

a head unit configured for installation within the swimming pool, wherein the head unit is fixed to a wall of the swimming pool;

a power pack disposed externally of the swimming pool; and an inverter drive system located externally of the swimming pool, wherein the head unit comprises:

a housing adapted to be mounted to an interior wall of the swimming pool, the housing comprises an upper half portion and a lower half portion, the lower half portion of the housing including a plurality of inlets positioned in central region of the housing, the plurality of inlets configured to receive pool water from deeper region of the swimming pool to enter the housing, a hydraulic motor disposed above the plurality of inlets, an impeller operatively coupled to and positioned above the hydraulic motor, a first water diffuser disposed above the impeller, a plurality of turning vanes located above the first water diffuser, a second water diffuser disposed adjacent to the plurality of vanes;

the power pack comprising:

a hydraulic pump disposed externally of the housing and operatively coupled to the hydraulic motor disposed within the housing;

an electric motor operatively connected to and configured to drive the hydraulic pump;

the hydraulic motor within the housing being configured to rotate the impeller to generate a directed flow of water within the swimming pool;

the inverter drive system:

is operatively connected to the electric motor, for powering and controlling the electric motor;

includes a controller configured to calibrate and control the operation of the inverter drive system, the controller being operatively connected to a user interface keypad;

wherein the electric motor is mechanically coupled to the hydraulic pump of the power pack, whereby the inverter drive system is operatively associated with the hydraulic pump through the electric motor;

wherein hydraulic communication between the hydraulic motor and the power pack is established via:

a hydraulic feedline extending between a pressure outlet of the power pack and an inlet of the hydraulic motor;

a hydraulic return line extending between an outlet of the hydraulic motor and an inlet of the power pack;

wherein said hydraulic feedline and hydraulic return line are routed through the housing via a plurality of support brackets.

2. The swimming machine according to claim 1, wherein the hydraulic motor is encased in a resin to make the hydraulic motor waterproof.

3. The swimming machine according to claim 2, wherein the resin is an epoxy resin.

4. The swimming machine according to claim 2, wherein the resin coating additionally has a chemical resistant gel top coat.

5. The swimming machine according to claim 1, wherein the electric motor is a 4 kW 3 phase motor.

6. The swimming machine according to claim 1, wherein the inverter drive system is a single phase to a three phase inverter drive system.

7. The swimming machine according to claim 1, wherein the hydraulic motor is a 50 CC hydraulic motor.

8. The swimming machine according to claim 1, wherein the impeller has approximately a 42 $cm^2$ area.

9. The swimming machine according to claim 1, wherein the inverter drive system is connected to a controller which is controlled by a user via a keypad.

10. The swimming machine according to claim 9, wherein the keypad is distal to the controller and both comprise a transmitter/receiver for a wireless communication.

11. The swimming machine according to claim 1, wherein the housing is substantially made from a fiberglass composite.

* * * * *